United States Patent [19]

Maier, II

[11] Patent Number: 5,024,067

[45] Date of Patent: Jun. 18, 1991

[54] FIT AND COOL BEVERAGE CONTAINER

[76] Inventor: Simeon E. Maier, II, 1750 92nd St., Caledonia, Mich. 49316

[21] Appl. No.: 400,805

[22] Filed: Aug. 30, 1989

[51] Int. Cl.[5] ..... F25D 3/08

[52] U.S. Cl. ..... 62/457.4; 62/457.5

[58] Field of Search ..... 62/457.4, 457.5, 457.1, 62/372, 464; 220/23.4

[56] References Cited

U.S. PATENT DOCUMENTS

| | | | |
|---|---|---|---|
| 3,161,031 | 12/1964 | Flannery | 62/457.4 |
| 4,299,100 | 11/1981 | Crisman et al. | 62/457.4 |
| 4,357,809 | 11/1982 | Held et al. | 62/457.4 |
| 4,516,409 | 5/1985 | Hobbs, Jr. et al. | 62/457.4 |
| 4,517,815 | 5/1985 | Basso | 62/457.5 |
| 4,624,383 | 11/1986 | Moore | 220/23.6 X |
| 4,656,840 | 4/1987 | Loofbourrow et al. | 62/457.9 X |
| 4,671,079 | 6/1987 | Petrantoni | 62/464 X |

*Primary Examiner*—Lloyd L. King
*Attorney, Agent, or Firm*—Kevin R. Peterson

[57] ABSTRACT

A container with a freezable liquid for use in or out of an ice chest for temporary cooling purposes. The container of the invention is generally to have a top and a bottom and four sides connected to form a rectangular box type structure. The sides are to have dovetail joints that work as a fastening means to connect more than one together, thus making for a longer lasting cooling means. The invention can also be made without dovetail joints in groups of one or more. These groups would also have a long lasting cooling effect as they would work similar to a block of water-ice. The container of the invention is to have a cylindrical opening in the top that rescinds down toward the bottom, said opening is to be about the size of a pop can. This cylindrical opening is the heart of the invention as it allows a cooling effect from around the periphery as well as the bottom.

1 Claim, 2 Drawing Sheets

FIT AND COOL BEVERAGE CONTAINER

BRIEF SUMMARY OF THE INVENTION

The invention relates to a container in which a beverage container can fit inside and be cooled from around the periphery as well as the bottom, thus making for a much quicker and longer cooling effect than many of the prior art methods. The invention container is to be filled with liquid, and cooled or frozen prior to use. This invention can be used singularly, in a fit-together group, or manufactured in a permanent group of one or more than could fit inside a lunch box type cooler. This invention can also be used instead of water-ice in many applications, thus eliminating the water mess inside an ice chest, on top of a table, or wherever this invention is used. The main use of this invention will be to cool a beverage in its container although not limited to this use as it can be used to keep perishable goods, medical supplies, etc. It is therefore an object of this invention to provide a cooling device that will cool from around the periphery as well as the bottom, and work independently or plurally in or out of an ice chest.

DETAILED DESCRIPTION OF THE DRAWINGS

Figure 1:
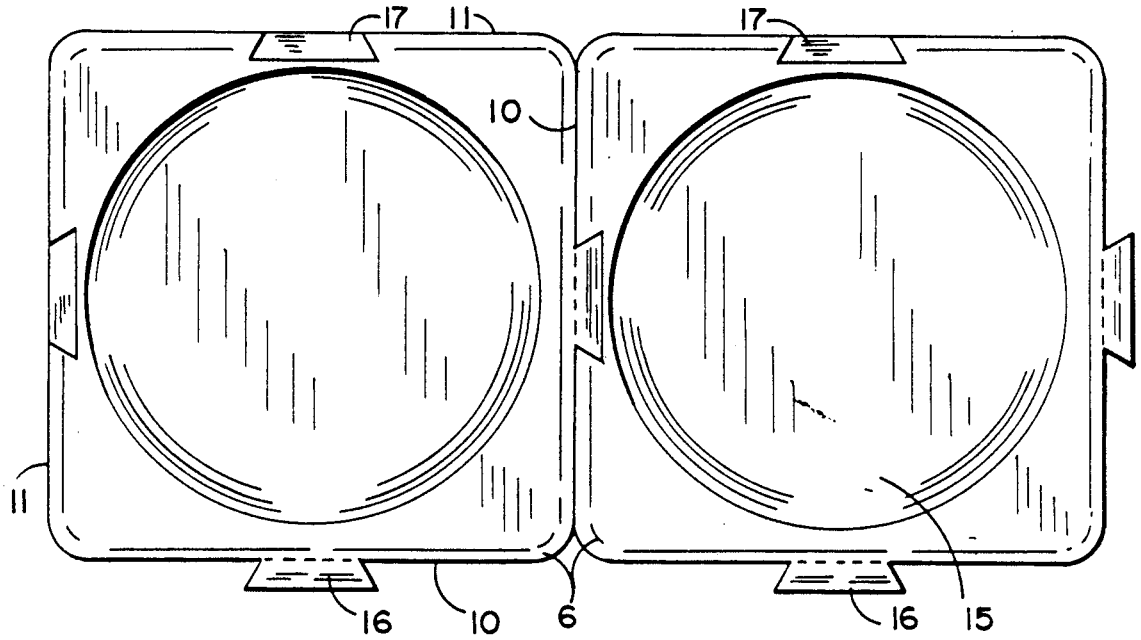
FIG. 1 is a top view of two singular containers joined together by means of a dovetail joint, also showing cylindrical cavities.
Figure 2:
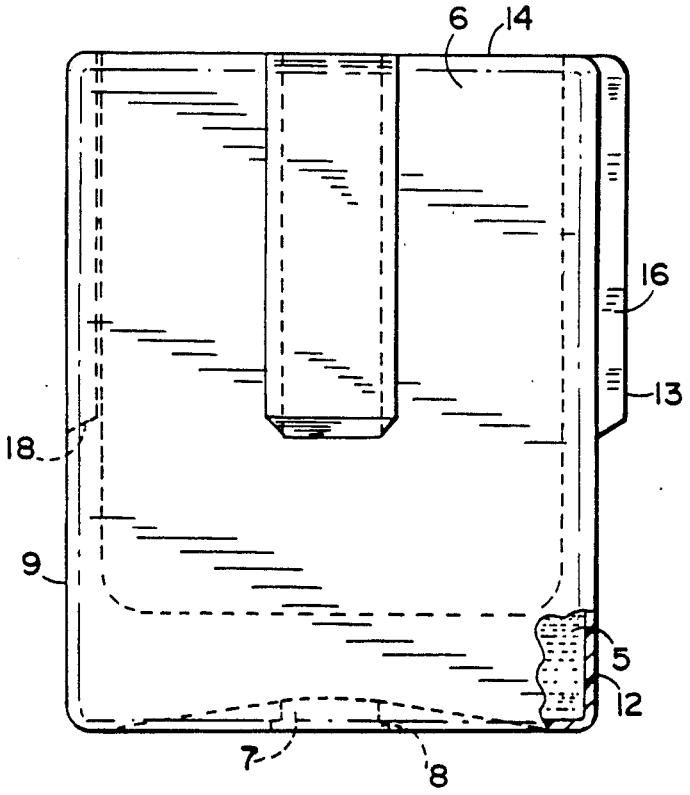
FIG. 2 is a side elevational view with a cut-away view to show cooling liquid, also showing filler neck and plug on the bottom side of the container.
Figure 3:
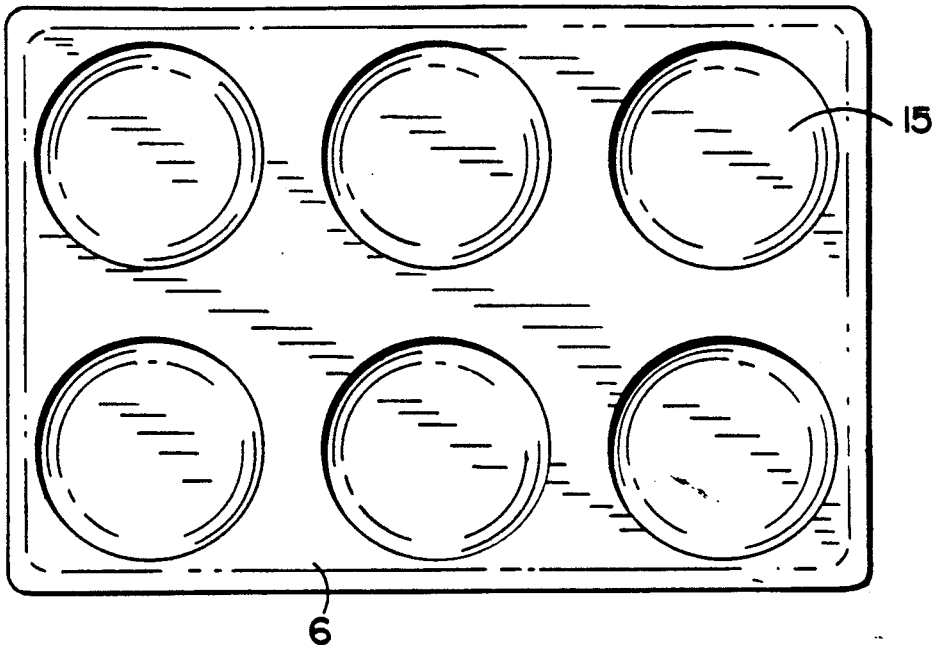
FIG. 3 is a side view of the invention manufactured without dovetail joints in a group of six.
Figure 4:
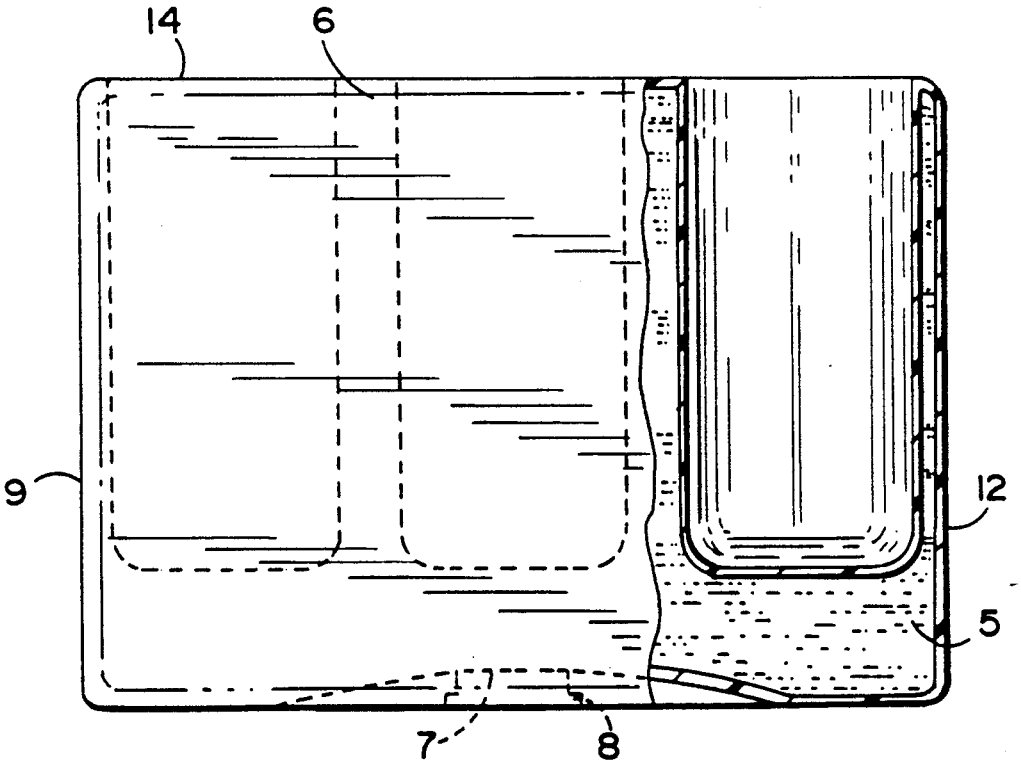
FIG. 4 is a side elevational view of FIG. 3 with a cut-away view A—A showing an inside cavity and the cooling liquid.

Referring to the drawing FIG. 1 and 2, the invention generally is designated by the No. 6 and will be called the F&CBC. F&CBC No. 6 is generally rectangular in length and is formed by the shell 12 which is to be constructed of material which is able to maintain ridged shape and adaptable to freezing temperatures, such as plastic. In FIG. 1 and 2 the four sides of No. 6 are generally of equal length that connect to form a square. Each side 11 has a recessed dovetail joint slot 17 that runs either the full length 9 or stops midway 9 as shown 13, this may vary as per application. Side 10 is in the contraposition from side 11 and has an opposite or protruding dovetail joint 16 that slides inside 17 and corresponds in position with side 11. A dovetail joint is used so the F&CBC can be extracted from an ice chest by pulling it vertically, thus separating one unit from a group. Dovetail joints are also shown to stop at point 18. This stop would be used so a person could pick up more than one unit by just lifting one unit. Referring to the cylindrical opening 15 in FIG. 1, 2, 3, and 4, this opening extends vertically down from the top 14 and houses the container to be cooled. This is the main feature that makes this invention novel. This opening is to be large enough in diameter and deep enough to facilitate maximum cooling along with ease of insertion and removal of said container—most likely to be a pop or beer can. The cut-away view 5 shows the shell 12 filled with a freezable liquid that is suitable for this application. This liquid will normally be installed at the factory through the filler neck 7 and sealed shut with a cap or plug 8. This invention can also be manufactured without the dovetail joints, and in groups of one or more as shown in FIG. 3 and 4, an object being to make the F&CBC more compact.

I claim:

1. A beverage container cooler comprising a shell constructed of plastic comprising an inner and outer wall, a liquid contained in the space between the inner and outer wall adapted to be frozen prior to use, A circular opening in the shell of a size to contain a beverage container, the exterior of said shell having four sides of equal length in the shape of a square, two of the adjoining sides containing a recessed dovetail joint slot and the other two adjoining sides containing protruding dovetails joints so that similar containers can be easily connected and removed.

* * * * *